United States Patent [19]

Arzola

[11] 4,033,069

[45] July 5, 1977

[54] MELODY BIRD INSTRUMENT

[76] Inventor: Rurico Arzola, Calle San Martin, No. 69-Urb. Villa Sol, Mayaguez, P.R. 00708

[22] Filed: July 31, 1975

[21] Appl. No.: 600,912

[52] U.S. Cl. ..... 46/52

[51] Int. Cl.[2] ..... A63H 5/00

[58] Field of Search ..... 46/52, 179, 66, 65

[56] References Cited

UNITED STATES PATENTS

| | | | |
|---|---|---|---|
| 140,206 | 6/1873 | Lee | 46/52 |
| 143,044 | 9/1873 | Waters | 46/179 |
| 157,095 | 11/1874 | Hawk | 46/52 |
| 450,495 | 4/1891 | Pugsley | 46/51 |
| 773,072 | 10/1904 | Griffin | 46/66 |
| 1,418,936 | 6/1922 | Kolanowski | 46/66 |
| 2,959,889 | 11/1960 | Gausewitz | 46/52 X |
| 3,040,474 | 6/1962 | Sirks | 46/52 |
| 3,413,753 | 12/1968 | Colmer | 46/65 X |

*Primary Examiner*—F. Barry Shay
*Attorney, Agent, or Firm*—Craig & Antonelli

[57] ABSTRACT

An instrument is provided for simulating melodious sounds of singing birds, such as tropical varieties, as well as the sounds of nighttime insects and small animals, such as the Puerto Rican "coqui". This instrument includes a construction having an air chamber with an elongated aperture and a small aperture for providing air circulation through the air chamber upon relative movement in air. The structure may be in the form of a rocket or satellite configuration. The method of operating this melody bird instrument is further provided.

17 Claims, 5 Drawing Figures

MELODY BIRD INSTRUMENT

The present invention relates to an instrument or device for obtaining melodious and harmonious sounds, such as resembling the sounds of tropical birds and animals. This instrument for producing pleasant and harmonious sounds is useful as an educational device for imitating the sounds of small birds of different countries, as well as small nighttime insects or animals, such as the little frog, or "coqui"of Puerto Rico.

This device is advantageous in the instruction in science and biology courses, such as physics and ornithology, since the sounds of melodious birds, for example, can be reproduced in the classrooms without the necessity of field study out-of-doors. In this regard, students of ornithology may be introduced to and become familiar with the sounds of tropical birds, for example, while in the laboratory or classroom. Such melodious and harmonious bird and animal sounds produced by the present instrument also enable simulation of many sounds that may be useful in the production of background sound tracks in movies and sound cassettes. Furthermore, the structure of the present invention provides an interesting toy which is entertaining for children by enabling them to reproduce various sounds.

The melody bird instrument of the present invention achieves these desirable features by means of a construction having a central air chamber with a longitudinal aperture for the entry of air and a small aperture at one end of the air chamber through which the air exits into a hollow base conical member having an open base portion. This assembly further includes a front conical section attached to the end of the air chamber opposite the base conical section. A holding member, such as a string, is attached at the front conical section for operation of the device. In this regard, the device is rotated about its longitudinal axis to circulate air through the longitudinal aperture of the air chamber and out of the base aperture through the base conical section, and subsequently swung through the air at the end of the string producing the desired melodious and harmonious sounds. These sounds can be varied by varying the rotation and speed of rotation of the device, swinging through the air, by increasing or decreasing wrist and arm rotation of the user's hand holding the end of the holding member or string.

Accordingly, an object of the present invention is an instrument for achieving melodious and harmonious sounds, resembling those of tropical birds and animals.

A further object of the present invention is a method for operating the instrument for producing the melodious and harmonious sounds of birds and tropical animals, such that these sounds can be achieved as desired.

These objects and other objects of the present invention may be further understood by reference to the following non-limitative embodiments, as illustrated in the drawing figures, wherein FIG. 1 is an exploded cross-sectional view of the present invention, taken on the line 1—1 of FIG. 3

Figure 1:
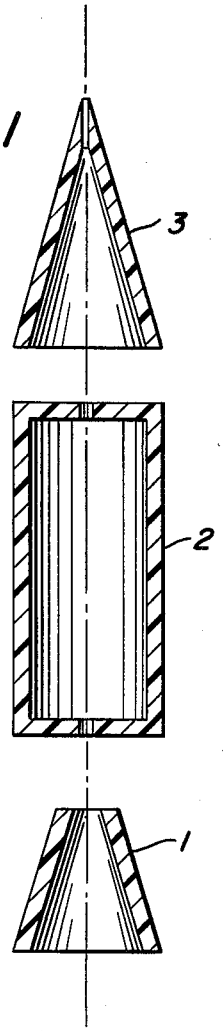

As illustrated in the drawing figures, the melody bird instrument is constructed with a resemblance to a rocket satellite, or command module of a satellite, in which a front conical shaped section 3 is located at the end of a substantially cylindrical hollow chamber 2 having a truncated hollow base conical section 1 secured to the opposite end of the central chamber 2. The central chamber 2 provides an air chamber through which air circulates through an elongated entrance slot at the periphery of the chamber 2 and out of a small hole 4 into the truncated hollow base conical section 1 through the open base portion. The circulation of air through the air chamber in this manner provides the melodious and harmonious sounds of the present invention, as hereinafter described.

The cylindrical central chamber 2, as well as the truncated cone 1, may be constructed of a plastic material, such as polyvinylchloride (PVC). This cylindrical member may have a length of two and 1/16 inches with a diameter of 13/16 inch.

Figure 3:
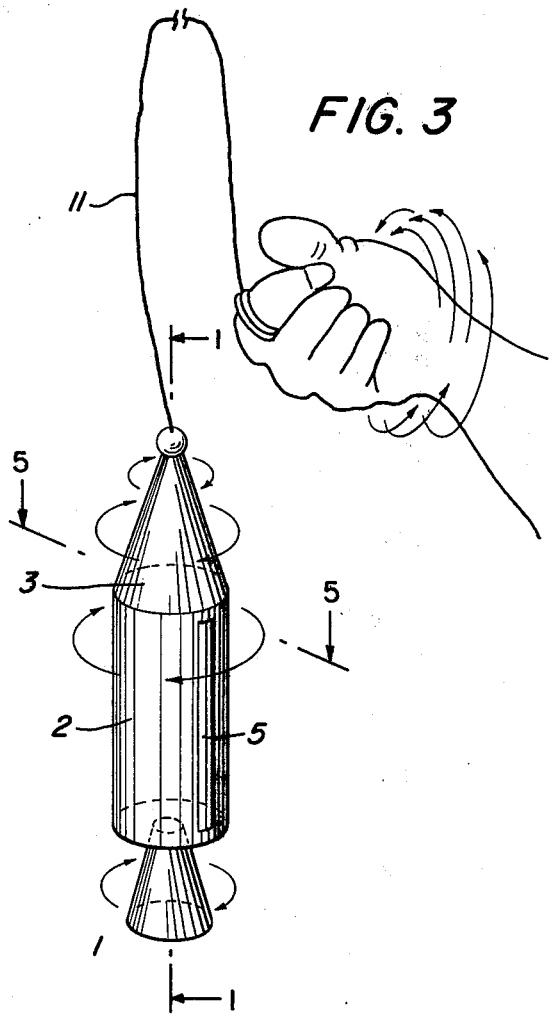
FIG. 3 is a perspective view of the present invention illustrating the use and operation thereof and showing movement of the user's hand.
Figure 5:
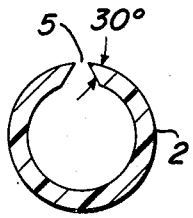
FIG. 5 shows a cross-sectional view taken on the line 5—5 of FIG. 3.

The elongated slot 5, illustrated in FIG. 3, may be provided with dimensions being about 1/16 to ⅛ inch in width for the outside opening and a one and ⅞ inch to two inches in length. Moreover, this aperture or slot 5 is bevelled into the interior surface of the central chamber 2 such as to provide an angle between the surface of the interior of the aperture and the peripheral exterior surface of the chamber 2. This angle may be in the range of about 30°.

The opening 4 of the central chamber 2 into the base conical section 1 may have a diameter of 1/16 inch.

Figure 2:
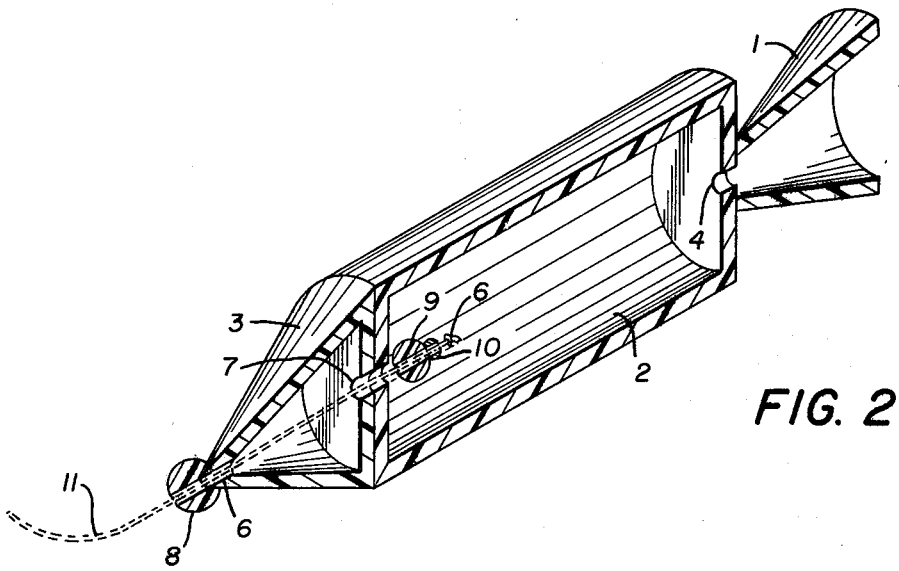
FIG. 2 is an isometric cross-sectional view of the structure of the present invention.

The front conical section 3 is secured to the end of the central chamber 2 opposite the base conical section, and includes two apertures 6, 7 at each end thereof, with the aperture 7 opening into the air chamber of the central chamber 2 and aperture 6 through the nose portion of the conical section 3 into the hollow interior thereof. This conical section 3 may also be constructed of PVC. For the operation of the device, a holding member, such as a nylon or polyester fiber string 11, is inserted through the apertures 6 and 7 into the air chamber, being also threaded through two plastic beads 8 and 9, as illustrated in FIG. 2, for the securing of the string to the melody bird assembly. The beads 8 and 9 may be of a plastic material and a small size such as a 5mm diameter. The bead 8 further provides a safety feature in that the end of the conical section 3 is blunted to avoid any damage occurring by striking of the assembly against an object. The string 11 is secured into the central chamber by knotting the end of the string after being threaded through a second smaller plastic ball 10 having a diameter of 3mm, for example.

The holding member 11 of nylon or polyester fiber string, for example, may have a length of 34 inches with a thickness of 1/32 inch, while the two apertures 6, 7 may have a diameter of 1/16 inch. Moreover, the end of the holding member 11 opposite the attachment to the melody bird assembly may be connected to a ring of a sufficient diameter, i. e. ⅞ to 1 inch, for inserting a finger to hold the structure in operation.

Figure 4:
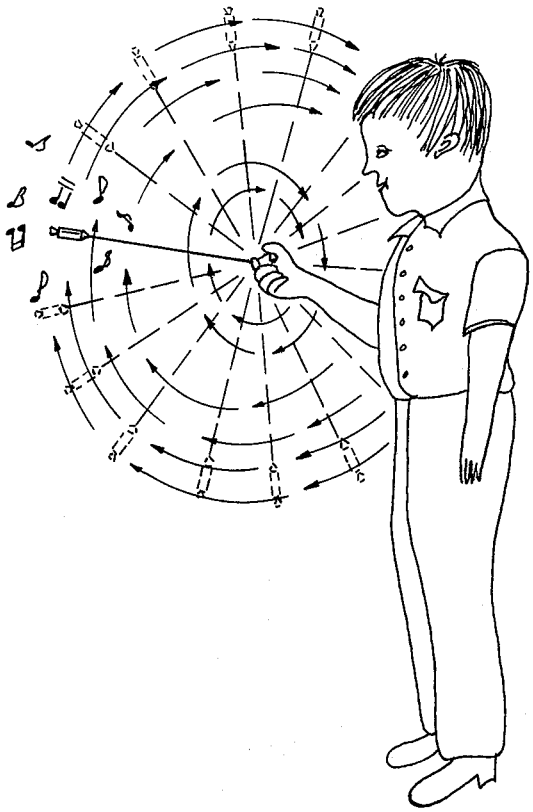
FIG. 4 illustrates an example of the use of the present invention.

The operation of the melody bird instrument may be seen by reference to FIGS. 3 and 4. Namely, the instrument is rolled-up with the string, while holding the ring in one finger. Thereafter, the instrument is set free to descend, thereby starting rotation about its longitudinal axis. Simultaneously with this movement of the instrument, the wrist and arm of the holder are moved in a circular manner, as illustrated in FIGS. 3 and 4 such as to cause the instrument to swing in a circular fashion at a radius corresponding to the length of the holding member 11.

This motion of the instrument causes air to circulate through the air chamber of the central chamber 2 by entering the elongated aperture 5 and exiting the small opening 4. Such circulation of the air through the air chamber produces whistles and echoes within the walls of the air chamber so that the melodious and harmonious sounds are achieved. By varying the motion of the wrist and arm, i.e. by providing soft or strong pulls on the string, variations in the sounds produced occur such that the melodious singing sounds of different tropical birds can be achieved, as well as the sounds of night insects and animals.

The produced sounds are so resemblant of the sounds of singing birds, that some birds answer the sounds of the instrument and come into the area at which it is operated. As such, a useful bird calling instrument is also achieved by this construction.

While I have shown and described one embodiment in accordance with the present invention, it is understood that the same is not limited thereto but is susceptible of numerous changes and modifications as known to a person skilled in the art, and I therefore do not wish to be limited to the details shown and described herein but intend to cover all such changes and modifications as are obvious to one of ordinary skill in the art.

What I claim:

1. An instrument for simulating sounds of singing birds and nighttime animals and insects, said instrument comprising air chamber means for circulating air therethrough upon relative movement of said air chamber means with respect to the air, said air chamber means including an elongated aperture into which the air enters said air chamber means, said elongated aperture having a pair of beveled edges, each having a bevel angle of 30° into the interior of said air chamber means, and a second aperture through which the air circulating within said air chamber means exits, thereby producing melodious and harmonious sounds; and means for controlling the movement of said air chamber means with respect to the air.

2. An instrument according to claim 1, wherein said air chamber means includes an elongated cylinder having closed ends with said elongated aperture being disposed through the peripheral cylindrical surface, and said second aperture being disposed through one of said closed ends.

3. An instrument according to claim 2, further comprising a hollow conical section secured to said air chamber means, said conical section having an open base portion such that air exiting through said second aperture passes out said open base portion into the atmosphere.

4. An instrument according to claim 3, further comprising a second hollow conical section having a closed base portion and including a small aperture through each of the nose portion of said second conical section and said closed base portion, wherein said second conical section is secured to said air chamber means at an end opposite to said hollow conical section through which said air passes.

5. An instrument according to claim 4, wherein said means for controlling the movement of said air chamber means is fixed to said second hollow conical section.

6. An instrument according to claim 5, wherein said means for controlling includes an elongated holding member being inserted through said apertures of said second conical section into said air chamber means.

7. An instrument according to claim 6, wherein said holding member is a flexible string having a knot at a first end within said air chamber means to secure said string thereto, and including a ring fixed to a second end of said string.

8. An instrument according to claim 1, wherein said means for controlling includes an elongated member being secured to said air chamber means.

9. An instrument according to claim 8, wherein said elongated member is a flexible string having a first end secured to said air chamber means and a second end fixed to a ring.

10. An instrument according to claim 1, further comprising a hollow conical section secured to said air chamber means, said conical section having an opening such that air exiting through said second aperture passes out into the atmosphere.

11. An instrument according to claim 10, further comprising a second hollow conical section having a closed base portion and including a small aperture through each of the nose portion of said second conical section and said closed base portion, wherein said second conical section is secured to said air chamber means at an end opposite to said hollow conical section through which said air passes.

12. An instrument according to claim 11, wherein said means for controlling includes an elongated flexible string having a first end extending through said small apertures in each of said nose portion and closed base portion of said second hollow conical section into said air chamber means and having a knot within said air chamber means to secure said string thereto, and including a ring fixed to a second end of said string.

13. An instrument according to claim 12, wherein said first end of said string passes through a first bead at said nose portion before extending through said small aperture, and passes through a pair of beads within said air chamber means before said knot.

14. An instrument according to claim 13, wherein said elongated aperture of said air chamber means has a width dimension of no more than ⅛ inch, and said second aperture of said air chamber means has a diameter of no less than 1/16 inch.

15. An instrument according to claim 10, wherein said elongated aperture of said air chamber means has a width dimension of no more than ⅛ inch, and said second aperture of said air chamber means has a diameter of no less than 1/16 inch.

16. An instrument according to claim 1, wherein said elongated aperture of said air chamber means has a width dimension of no more than ⅛ inch, and said second aperture of said air chamber means has a diameter of no less than 1/16 inch.

17. A method of producing a sound simulating sounds of singing birds and nighttime animals and insects, said method comprising selecting an instrument, said instrument comprising air chamber means for circulating air therethrough upon relative movement of said air chamber means with respect to the air, said air chamber means including an elongated aperture into which the air enters said air chamber means, said elongated aperture having a pair of beveled edges, each having a bevel angle of 30° into the interior of said air chamber means, and a second aperture through which the air circulating within said air chamber means exits, thereby producing melodious and harmonious sounds; said instrument including means for controlling the movement of said air chamber means with respect to the air, said method further comprising the steps of rotating said air chamber means about an axis parallel to the direction of elongation of said elongated aperture by said means for controlling, and simultaneously swinging said air chamber means in a circle by said means for controlling, such that air passes into said air chamber means through said elongated aperture and out of said air chamber means through said second aperture, thereby producing said melodious and harmonious sounds.

* * * * *